US005598890A

United States Patent [19]

Richard et al.

[11] Patent Number: 5,598,890

[45] Date of Patent: Feb. 4, 1997

[54] COMPLETION ASSEMBLY

[75] Inventors: Bennett M. Richard, Kingwood; Benn A. Voll, Houston, both of Tex.

[73] Assignee: Baker Hughes Inc., Houston, Tex.

[21] Appl. No.: 551,931

[22] Filed: Oct. 23, 1995

[51] Int. Cl.[6] ..... E21B 33/16; E21B 43/10

[52] U.S. Cl. ..... 166/276; 166/50; 166/205; 166/291; 166/296; 166/386

[58] Field of Search ..... 166/50, 51, 205, 166/228, 276, 278, 285, 291, 296, 386

[56] References Cited

U.S. PATENT DOCUMENTS

| | | | |
|---|---|---|---|
| 4,127,173 | 11/1978 | Watkins et al. | 166/278 X |
| 4,443,233 | 4/1984 | Moran . | |
| 4,671,359 | 6/1987 | Renfro | 166/312 |
| 4,801,379 | 1/1989 | Ehrsam et al. . | |
| 4,842,068 | 6/1989 | Vercaemer et al. | 166/269 |
| 4,856,591 | 8/1989 | Donovan et al. | 166/278 |
| 4,858,690 | 8/1989 | Rebardi et al. | 166/278 |
| 4,858,691 | 8/1989 | Ilfrey et al. | 166/278 |
| 4,869,323 | 9/1989 | Stagg | 166/285 |
| 4,995,456 | 2/1991 | Cornette et al. | 166/50 X |
| 5,040,601 | 8/1991 | Karlsson et al. | 166/50 X |
| 5,115,860 | 5/1992 | Champeaux et al. | 166/51 |
| 5,200,072 | 4/1993 | Frejborg et al. | 210/232 |
| 5,211,234 | 5/1993 | Floyd | 166/276 |
| 5,259,512 | 11/1993 | Czerwoniak | 209/273 |
| 5,289,876 | 3/1994 | Graham | 166/50 X |
| 5,301,760 | 4/1994 | Graham | 166/386 X |
| 5,377,750 | 1/1995 | Arterbury et al. | 166/228 X |
| 5,526,880 | 6/1996 | Jordan, Jr. et al. | 166/291 |

OTHER PUBLICATIONS

Santrol Technical Bulletin, "Super LC", date unknown, 1–4.

*Primary Examiner*—George A. Suchfield
*Attorney, Agent, or Firm*—Rosenblatt & Redano P.C.

[57] ABSTRACT

The invention involves an assembly, specifically beneficial in deviated well-bores, which allows running into the well-bore with the complete completion assembly. The completion assembly includes one or more screens which may be pre-packed. Initially, a material which sets to form a permeable mass is deposited in the annular space outside the screens. After such material is deposited, cement or other sealing material is pumped into the annular space above the screens to complete the completion process. As a result, in one trip the deviated wellbore is completed with the permeable material deposited outside the screen or screens and cement being disposed in the annular space above the permeable material. Production can then begin.

19 Claims, 1 Drawing Sheet

COMPLETION ASSEMBLY

FIELD OF THE INVENTION

The field of this invention relates to completion systems, particularly those for offset or deviated wellbores.

BACKGROUND OF THE INVENTION

In the past, in order to facilitate removal of gases and hydrocarbons from existing formations, inclined or deviated wellbores have been used with greater frequency to improve productivity. Completions in such wellbores have been problematic in certain applications. For instance, traditional methods of running casing and cementing it present difficulties when the wellbore is almost horizontal. It is difficult to obtain uniform coverage of the cement when the wellbore is deviated. This occurs because gravity works to force the cement downwardly so that if the entire annulus is not sufficiently filled, the integrity of the cementing job is jeopardized or lost. Additionally, even if it were possible to reliably cement casing in a deviated wellbore, a subsequent step of perforating must also occur.

Prior designs have employed slotted or otherwise pre-perforated liners which are simply placed in the deviated segment of the wellbore. The production from the formation occurs through the slotted casing. Frequently, if the formation is unconsolidated, the slotted casing may plug. Similarly, any screens installed on the bottom of the production tubing installed into the casing may also plug if the movement of fluid brings with it a large amount of solids into the screen area.

While gravel-packing is a technique that has been used in the past to eliminate screen blockages and to facilitate production, many techniques of gravel-packing which work quite well in vertical wellbores become problematic in deviated wellbores. Again, the distribution of the gravel-packed material completely around a screen is more difficult to accomplish in place in a deviated wellbore due to the effects of gravity.

As an alternative to slotted casing, pre-packed screens that have already affixed to them a layer or layers of gravel or other granular materials have been used. However, in situations where the formation is unconsolidated and large amounts of solids are produced, even pre-packed screens exhibit clogging and undue pressure drops, thereby diminishing the productivity of the well.

Accordingly, it is desirable to provide a one-trip method which can eliminate the need for casing which must be perforated if cemented in a deviated wellbore. Additionally, it is desirable to create a system involving few steps, the end result of which will be the proper placement of screens which can be made ready for production upon the opening of sleeve-type valves. Additionally, the method of the invention places a permeable, settable material on the outside of the screens to facilitate production from the formation while decreasing the prospects of clogging of the screens. Finally, a method would be desirable which isolates the cement which is ultimately used from the permeable material which is in the annular space outside the screens. These objectives and others have been accomplished by the apparatus and method of the present invention as will be outlined below.

SUMMARY OF THE INVENTION

The invention involves an assembly, specifically beneficial in deviated well-bores, which allows running into the wellbore with the complete completion assembly. The completion assembly includes one or more screens which may be pre-packed. Initially, a material which sets to form a permeable mass is deposited in the annular space outside the screens. After such material is deposited, cement or other sealing material is pumped into the annular space above the screens to complete the completion process. As a result, in one trip the deviated wellbore is completed with the permeable material deposited outside the screen or screens and cement being disposed in the annular space above the permeable material. Production can then begin.

DETAILED DESCRIPTION OF THE PREFERRED EMBODIMENT

Figure 1:
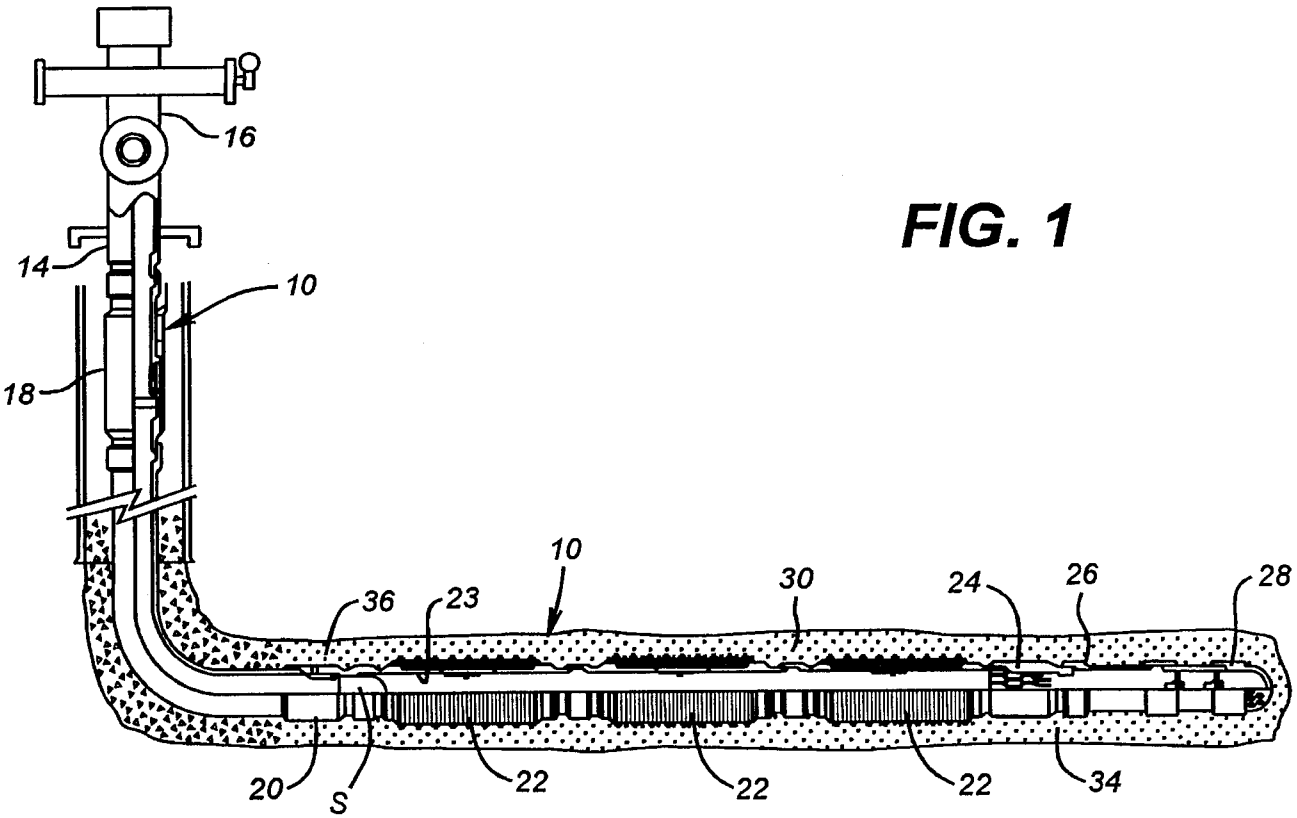
FIG. 1 is a sectional elevational view of the assembly of the present invention shown at the conclusion of the completion procedure.
Figure 2:
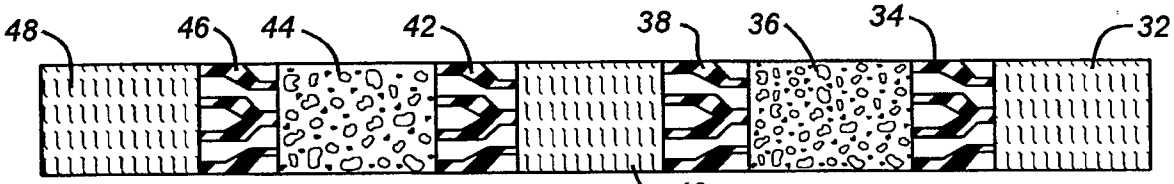
FIG. 2 illustrates in a schematic manner the sequence of events necessary to accomplish the end result shown in FIG. 1.

The component assembly is illustrated in FIG. 1. FIG. 1 illustrates schematically a wellbore 10, which in this case is cased by casing 12. A tubing string 14 is connected to surface equipment, shown schematically as 16. As part of the tubing string 14, a subsurface safety valve 18 can be employed. The tubing string 14 continues to a stage collar/cementing valve 20, which is of a type well-known in the art. Below the stage collar/cementing valve 20 is one or more screens 22. Such screens are of known designs and in the preferred embodiment, a pre-packed screen having a thin, porous layer of a filtering medium secured externally, such as that sold by Baker Hughes Inteq under the mark "SELECT-A-FLOW®", can be used to implement the invention. However, other screens can be used without departing from the spirit of the invention. Located internally to screen assemblies 22 is a sleeve valve 23, shiftable from the surface between an open and closed position with a shifting tool S shown schematically in position and operable from the surface in a known manner. The sleeve valve 23 can be manipulated by a known shifting tool S to block flow to the tubing string 14 until the completion process, as will be described, is finished. Shifting tool S is only inserted when it is required to move sleeve valve 23 between its open and closed positions. Located below the screens 22 is a landing collar 24. Landing collar 24 is of a design well-known in the art and is for the purpose of catching one or more wiper plugs, as will be described below. Located below the landing collar 24 is a pup joint 26 which is nothing more than an extension to which connects the set shoe 28 to the landing collar 24. The set shoe 28 is also the type well-known in the art which functions similarly to a check valve to allow fluids to exit the tubing string 14 into the annular space 30. Similarly, the stage collar/cementing valve 20 can be positioned for access into the annular space 30, as will be described below.

Having placed the assembly illustrated in FIG. 1 into the deviated wellbore 10, the completion procedure can be started by pumping an initial charge of brine 32 through the set shoe 28 and out into the annulus 30. A first wiper plug 34 is dropped on top of the brine 32 and pumped downhole toward landing collar 24. FIG. 1 shows the initial wiper plug 34 caught in the landing collar 24. The initial charge of brine 32 is used to hold bottomhole pressure in check. Ultimately, the initial wiper plug 34 is landed in the landing collar 24, followed by a predetermined amount of gravel slurry 36. The gravel slurry is made of phenolic-coated sand such as that commonly sold by Baker Hughes Inteq under the name "BAKER BOND®". This material contains sand generally in three size ranges between 40–60 mesh or 20–40 mesh or 12–20 mesh, depending on the characteristics of the formation against which it will be deposited. However, other size ranges can be employed without departing from the spirit of the invention. This material can also be obtained from the Santrol Products Company in Houston, Tex., under the product designation "SUPER LC", which is a curable resin-coated proppant applied to crystalline silica sand produced from Ottawa-type sandstone formations. The sand is coated with the curable resin under methods described in U.S. Pat. Nos. 4,518,039 and 4,597,991. The material is applied as described in the literature available from Santrol and similar literature about the BAKER BOND product available from Baker Hughes Inteq. The slurry 36 is backed by a wiper plug 38. Ultimately, the volume of slurry 36 is pushed out beyond plug 34 and through the set shoe 28 and into the annular space 30, as indicated in FIG. 1. A predetermined volume is computed so that when the wiper plug 38 bottoms on plug 34, as shown in FIG. 1, the slurry 36 disposes itself outside of the screens 22 and generally up to the area of the stage collar/cementing valve 20. Additional brine 40 acts as a spacer between the second plug 38 and the third plug 42. The third plug 42 gets caught in the stage collar/cementing valve 20 to open up the cementing valve and to close off the tubing string 14 to the screens 22. A cementitious material or other sealing material 44, such as blast furnace slag, is then pumped behind the third plug 42. The sealing material 44 enters the annular space 30 above the gravel slurry 36 and goes up and into the casing 12, as illustrated in FIG. 1. At that time, a fourth wiper plug 46 is pumped down behind the sealing or cementitious material 44 and eventually bottoms on the stage collar/cementing valve 20. The fourth plug 46 is pumped down with another volume of brine 48. When the fourth plug 46 bottoms in the stage collar/cementing valve 20, the tubing 14 is wiped clean of the sealing or cementitious material 44 and the excess material 44 is fully displaced into the annular space 30 above the gravel slurry 36, as indicated in FIG. 1. Thereafter, the plugs 42 and 46 are destroyed by known means, such as drilling out, to open access to screens 22.

Thereafter, in the accustomed way in the art, the sliding sleeve valves within the screens 22 are moved by a known shifting tool and production can begin through the gravel slurry material which by this time has already set up but is sufficiently porous to allow flow therethrough to reach the screens 22.

The layer of the cement material or other material 44 in the annulus 30 helps to seal out gases or water in the formation from the screens 22.

The result of the procedure outlined above is that in one step, all of the necessary equipment can be positioned in the wellbore 10. The use of slotted casing is eliminated and a gravel slurry 36 is used which ultimately sets up but is permeable to allow flow of formation fluids through it into the area of the screens 22. Additionally, the sealing or cementitious material 44 is not pumped through the screens 22 and into the annular space outside. Accordingly, no perforation is required with a gun. The gravel slurry material 36 merely is allowed to set up, using the subsurface temperature in the formation, whereupon the gravel slurry 36 acts as a porous material to catch solids gravitating toward the screens 22 before they actually get that far. While some of the solids from the formation may reach the screens, the annulus 30 in the area of the screens 22 is, in essence, filled with the gravel slurry material 36. Even if annulus 30 around screens 22 is not totally filled, the assembly will still function, with most flow going through the porous material 44, even if uncovered portions of screens 22 are blocked with solids. By doing calculations of the expected volume of the annulus in the area of the screens 22, the pumping action is controlled to ensure that the annulus area 30 is properly filled around the screens 22. As a result, a one-step system is available for deviated wellbores in particular where the finished arrangement, as reflected in FIG. 1, improves the performance of the screens 22 and their resistance to plugging from formation solids. The addition of the cement in the annular space 30 above the gravel slurry material 36 further secures the area of the screens 22 against gases or water that may be in the wellbore 10 above the area of the screens 22.

The foregoing disclosure and description of the invention are illustrative and explanatory thereof, and various changes in the size, shape and materials, as well as in the details of the illustrated construction, may be made without departing from the spirit of the invention.

We claim:

1. A completion method for a deviated wellbore, comprising:

joining at least one screen to tubing;

running the screen to a predetermined depth in the wellbore using said tubing;

pumping a settable permeable material into an annular space in the wellbore outside said screen.

2. The method of claim 1, further comprising:

placing a sealing material above said permeable material in the annular space created by the tubing.

3. The method of claim 2, further comprising:

said screen having an elongated shape with a flowpath therethrough;

pumping the permeable material through said flowpath of said screen with the openings through said screen initially blocked.

4. The method of claim 2, further comprising:

allowing the permeable material to set before pumping the sealing material.

5. The method of claim 4, further comprising:

accessing the annular space above the set permeable material through a valve mounted above said screen to said tubing.

6. The method of claim 5, further comprising:

wiping the tubing through said screen after pumping said permeable material.

7. The method of claim 6, further comprising:

using a plug to operate said valve to gain access to the annular space above said screen and to block, at least temporarily, access to said screen.

8. The method of claim 7, further comprising:

wiping the sealing material from the tubing and through said valve.

9. The method of claim 8, further comprising:

closing said valve after wiping said sealing material into the annular space outside said tubing.

10. The method of claim 8, further comprising:

reopening access in the tubing to said screens.

11. The method of claim 10, further comprising:

removing at least one plug adjacent said valve to accomplish said reopening.

12. The method of claim 11, further comprising:

using an internal sliding sleeve valve to initially block flow through said screen.

13. The method of claim 12, further comprising:

using a shifting tool to open said sliding sleeve valve prior to initiating production.

14. The method of claim 1, further comprising:

using a set shoe below said screen;

pumping said settable permeable material through said shoe.

15. The method of claim 14, further comprising:

using a wiper plug below and above said settable permeable material to pump it into said tubing.

16. The method of claim 15, further comprising:

using a wiper plug below and above said sealing material to pump it into said tubing.

17. The method of claim 16, further comprising:

using a spacer fluid to separate the pumping of said permeable material from said sealing material.

18. The method of claim 1, further comprising:

using resin-coated sand as said settable permeable material.

19. The method of claim 1, further comprising:

using a plurality of said screens;

applying a prepacked outer layer to each screen prior to insertion into the wellbore.

* * * * *